US008146882B2

(12) United States Patent
Corredor Molguero et al.

(10) Patent No.: US 8,146,882 B2
(45) Date of Patent: Apr. 3, 2012

(54) MOLD FOR MANUFACTURING CONCRETE CUBIPOD

(75) Inventors: Antonio Corredor Molguero, Madrid (ES); Carlos Fermin Menéndez Diaz, Madrid (ES)

(73) Assignee: Sociedad Anonima Trabajos y Obras Gobelas, Madrid (ES)

( * ) Notice: Subject to any disclaimer, the term of this patent is extended or adjusted under 35 U.S.C. 154(b) by 98 days.

(21) Appl. No.: 12/676,928

(22) PCT Filed: May 8, 2008

(86) PCT No.: PCT/ES2008/000330

§ 371 (c)(1),
(2), (4) Date: Jun. 9, 2010

(87) PCT Pub. No.: WO2009/030787

PCT Pub. Date: Mar. 12, 2009

(65) Prior Publication Data

US 2010/0258704 A1 Oct. 14, 2010

(30) Foreign Application Priority Data

Sep. 7, 2007 (ES) ..... 200702396

(51) Int. Cl.
*B28B 7/00* (2006.01)
*E02B 3/14* (2006.01)

(52) U.S. Cl. ..... 249/139; 249/161; 249/168; 249/171; 425/213; 425/442; 425/470

(58) Field of Classification Search ..... 249/18, 249/67, 68, 117, 120, 121, 139, 155–156, 249/160–163, 165, 168–172, 204, 210, 212; 425/330, 441, 442, 438, 470, 213; 264/34, 318, 333, 334; 405/29
See application file for complete search history.

(56) References Cited

U.S. PATENT DOCUMENTS 3,009,229 A 11/1961 Tumey
(Continued)

FOREIGN PATENT DOCUMENTS

DE 2 710 177 9/1978
(Continued)

OTHER PUBLICATIONS

International Search Report issued Sep. 1, 2008 in International (PCT) Application No. PCT/ES2008/000330.

*Primary Examiner* — Dimple Bodawala
(74) *Attorney, Agent, or Firm* — Wenderoth, Lind & Ponack, L.L.P.

(57) ABSTRACT

Cubipods are heavy concrete objects used as protection means for dyke or breakwater mantles on coasts or the like and have a cubic or orthohedral shape with projections on the faces (3) thereof; the number, position and geometric shape of said projections (2) may vary. The mold comprises a table (4) with a plate (6) wherein is hollowed a recess (5) corresponding with the lower projection of the cubipod (1) and has support legs (9) on a rigid plinth (10). A prismatic casing (11) with the cubipod (1) shape but lacking the upper base, rests on the table (4). A frame of profiles (18, 19) with a hood (17) for forming the upper projection is hinged on an upper edge. Mould removal is achieved by raising the casing (11), after taking away a number of dihedral surfaces (14-15) which form the lower face of the projections (2) and lower part of the casing.

4 Claims, 8 Drawing Sheets

U.S. PATENT DOCUMENTS

| | | | | | |
|---|---|---|---|---|---|
| 3,259,679 | A | * | 7/1966 | Nielsen | 264/242 |
| 3,355,137 | A | * | 11/1967 | Tsuzuki | 249/48 |
| 3,582,034 | A | | 6/1971 | Tsuzuki | |
| 3,813,076 | A | * | 5/1974 | Draughon et al. | 249/50 |
| 3,830,458 | A | * | 8/1974 | Hamblin | 249/50 |
| 3,977,646 | A | * | 8/1976 | Moon et al. | 249/50 |
| 4,022,859 | A | * | 5/1977 | Fioretto | 264/69 |
| 4,091,928 | A | * | 5/1978 | Bernardo | 206/575 |
| 4,594,023 | A | | 6/1986 | O'Neill | |
| 5,667,200 | A | * | 9/1997 | Kelley, Jr. | 264/219 |
| 6,814,906 | B2 | * | 11/2004 | Bergeron et al. | 264/39 |
| 6,835,343 | B2 | * | 12/2004 | Manthei et al. | 264/271.1 |
| 7,137,800 | B1 | * | 11/2006 | Longo | 425/111 |
| 7,976,763 | B2 | * | 7/2011 | Reedijk et al. | 264/333 |
| 2003/0160147 | A1 | * | 8/2003 | Manthei | 249/171 |
| 2008/0286045 | A1 | * | 11/2008 | Folgado et al. | 405/29 |

FOREIGN PATENT DOCUMENTS

| | | | | |
|---|---|---|---|---|
| GB | 2072082 | A | * | 9/1981 |
| JP | 48-026215 | | | 4/1973 |
| JP | 63-102908 | | | 5/1988 |
| JP | 06099420 | A | * | 4/1994 |
| JP | 9-242044 | | | 9/1997 |
| JP | 09242044 | A | * | 9/1997 |
| JP | 2005-290791 | | | 10/2005 |
| JP | 2005290791 | A | * | 10/2005 |
| WO | 2004/009910 | | | 1/2004 |

* cited by examiner

MOLD FOR MANUFACTURING CONCRETE CUBIPOD

OBJECT OF THE INVENTION

The present invention according to what is expressed in the statement of this specification, relates to a mould for manufacturing concrete cubipods, these being of a cubic or orthohedral shape and provided at their faces or at part of them, with some preferably truncated pyramid-shaped protuberances or projections, with square base, although they can also adopt other geometrical forms such as pyramidal, hemispherical, etc.

Said projections may be centered at the faces of the cube or cuboid, or may vary both, in position and in number.

These cubipods are heavy and large sized elements and constructed from concrete, with which sloping dyke mantles for protecting the coasts against swell or other sea constructions (breakwaters, jetties) are formed. Its assembly is carried out by randomly locating them and by obtaining a good joining among them at the different layers of the structure, preventing the coupling between their faces due to the projections.

It is an object of the invention to offer a mould allowing a readily and quickly construction of these cubipods, making it also a simple operation the removal of the mould.

BACKGROUND OF THE INVENTION

In the invention patent no. 200501750 an element for forming dyke mantles is disclosed, with which the known problems are attempted to be solved when manufacturing an artificial breakwater for shelter and protection of the coasts, these being elements of the type previously mentioned in order to achieve a good joining among pieces.

DESCRIPTION OF THE INVENTION

Generally, the mould for manufacturing concrete cubipods, allows manufacturing this type of elements with different shapes and sizes, only by providing the mould or formwork to possess at the suitable places corresponding to the projections, the movable devices allowing the removal of formwork, once the concrete poured in the mould is set, to be readily carried out without displacement of mass or heavy parts thereof, by means of the simple raising of the formwork with a suited tool constructed for that purpose, detaching the metal side walls from the concrete block formed.

The mould under discussion includes a rigid support structure defining a table comprising sheets and profiles arranged over metal legs anchored to a rigid plinth, its geometry being determined by the bottom of the mould or bottom face of the block to be formed, including its lug, or lugs. In order to simplify the description we will refer to the construction of a cube with projections centered on its faces and with a truncated pyramid shape as we will see in the preferred embodiment. This base shall support the weight of the rest of the moving formwork of the concrete formed piece.

The moving formwork is a sheet casing or prismatic surface (the lateral one of the cube) with reinforcement laminated metal profiles (both vertical and horizontal) which provide the proper rigidity and strength to the assembly. This casing fits in the table and is fixed to it with suitable pins, being slightly truncated pyramid-shaped in order to facilitate the removal of the mould and is provided, on its walls, with the sheet lugs or projections which determine the recesses which will be filled with concrete in order to constitute the projections.

In order to be able to remove the formwork by raising it, the bottom face of the truncated pyramid-shaped projections and the rectangular portion of the cube located under the projection form a dihedral surface which is hinged at the minor base of said projection. Thus, it is not necessary to dismantle or separate formwork parts but only to release the fixing pins which held the closed position.

The projection of the upper base is formed at a final stage, once the pouring of the fresh concrete has been effected by filling the mould up to the rim of the casing or "jelly mould". One of the upper edges is hinged to a frame of profiles to which a truncated pyramid-shaped hood with the geometry of the projection to be formed is joined. Once folded, placed in position and anchored with pins, it is filled with new concrete pouring.

With this arrangement, the manufacturing process of the cubipod with the mould being described is the following:

- The casing or jelly mould is placed on the table, fixing it by means of the proper pins. The formwork is cleaned, the side moving panels or dihedral plates of the bottom part of the lugs or projections are closed and all the interior part is impregnated with concrete release agent when necessary.
- Fresh concrete is poured in the interior of the mould up to the rim of the upper edge (by gravity or by pumping), suitably vibrating it.
- The moving frame carrying the truncated pyramid-shaped hood with which the upper lug or projection should be formed is tilted and fixed by means of pins.
- The concrete is poured or pumped in said hood by its upper face and it is vibrated in order to achieve the joining with the rest of the block.
- After the time corresponding to the hardening or setting of the concrete has passed, the moving dihedral plates are released (both from the upper lug and the side lugs) and the mould is pulled by means of a tool for that purpose in order to detach the metal side walls of the block.
- Once the suitable strength in the concrete of the cubipod for being able to remove the mould without any risks for its integrity has been achieved, the suited tool for raising the mould is utilized, placing it in another table for the next manufacturing.
- Once the suitable strength in the concrete of the block for its handling has been achieved, it is raised for its storing, clearing the table.
- The table is cleaned and prepared for the next block.

The mould is also prepared with the proper mechanisms for its partial opening, its placing and other means which facilitate the work of the operators on it, such as platforms or passageways, handrails, etc.

In order to facilitate the understanding of the characteristics of the invention and being an integral part of this specification, some figures sheets are attached on which figures, with an illustrative but not limiting character, the following has been represented:

DESCRIPTION OF THE PREFERRED EMBODIMENT

Figure 1:
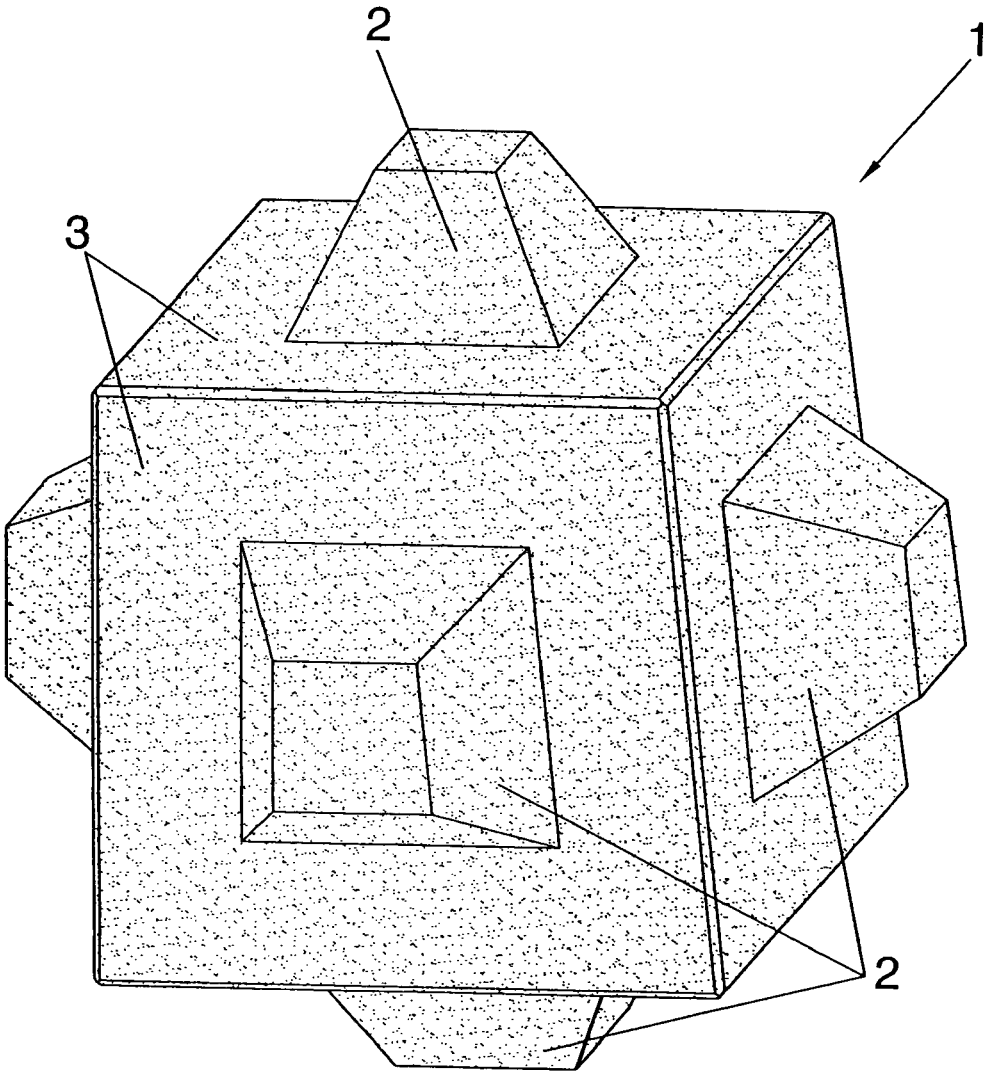
FIG. 1.—Is a perspective view of the cubipod to be constructed with the mould object of the invention.
Figure 2:
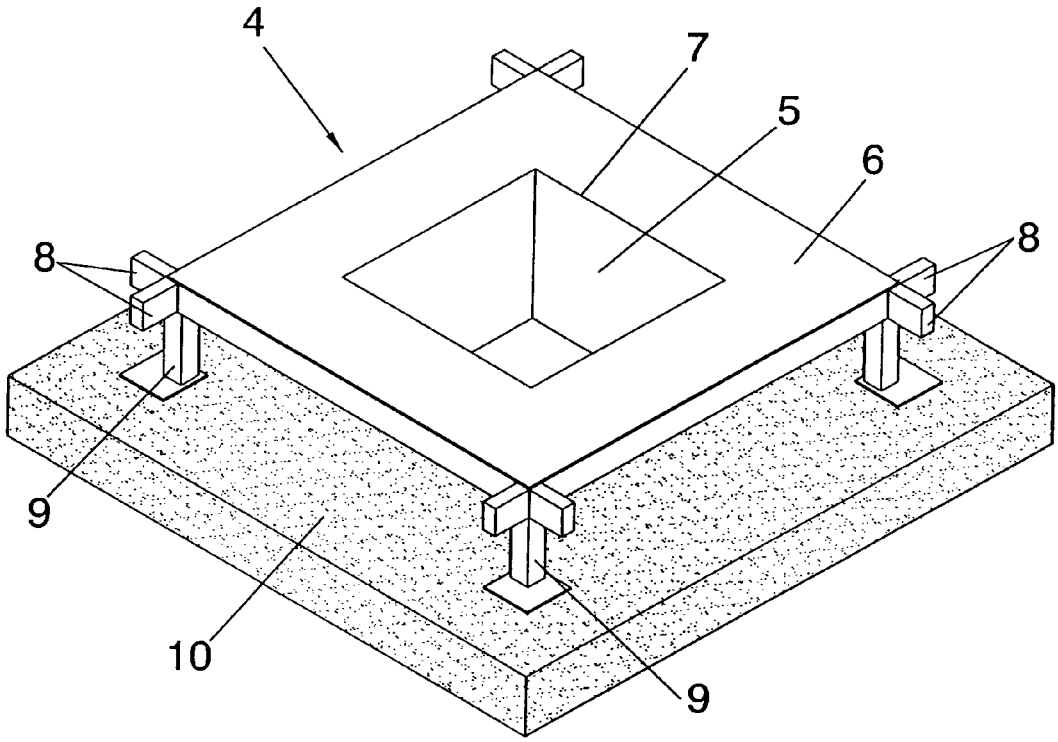
FIG. 2.—Is a perspective view of the support base or table of the mould object of the invention.

Referring to the numbering adopted in the figures and specially with respect to FIG. 1 wherein is shown the body or piece to be built in the mould object of the invention, according to a preferred embodiment, we can see that the cubipod thus defined is generally referred to with number 1 and presents the shape of a cube or hexahedron with truncated pyramid-shaped projections or bulkiness 2 with square base and centered on its faces 3.

In turn, the mould object of the invention is shown in FIGS. 2 to 8 and formed by a table 4 (FIG. 2) with the dimensions of the base of the cube or cuboid (in this case cube) and with the sheet recesses corresponding to the projections provided at the face, (in this case one and centered). The plate 6 carries a window 7 having integrally joined the inverted truncated pyramid-shaped surface forming in this case the recess 5. The plate 6 rests on the frame of profiles 8 with metal legs 9 anchored to the plinth 10.

Figure 3:
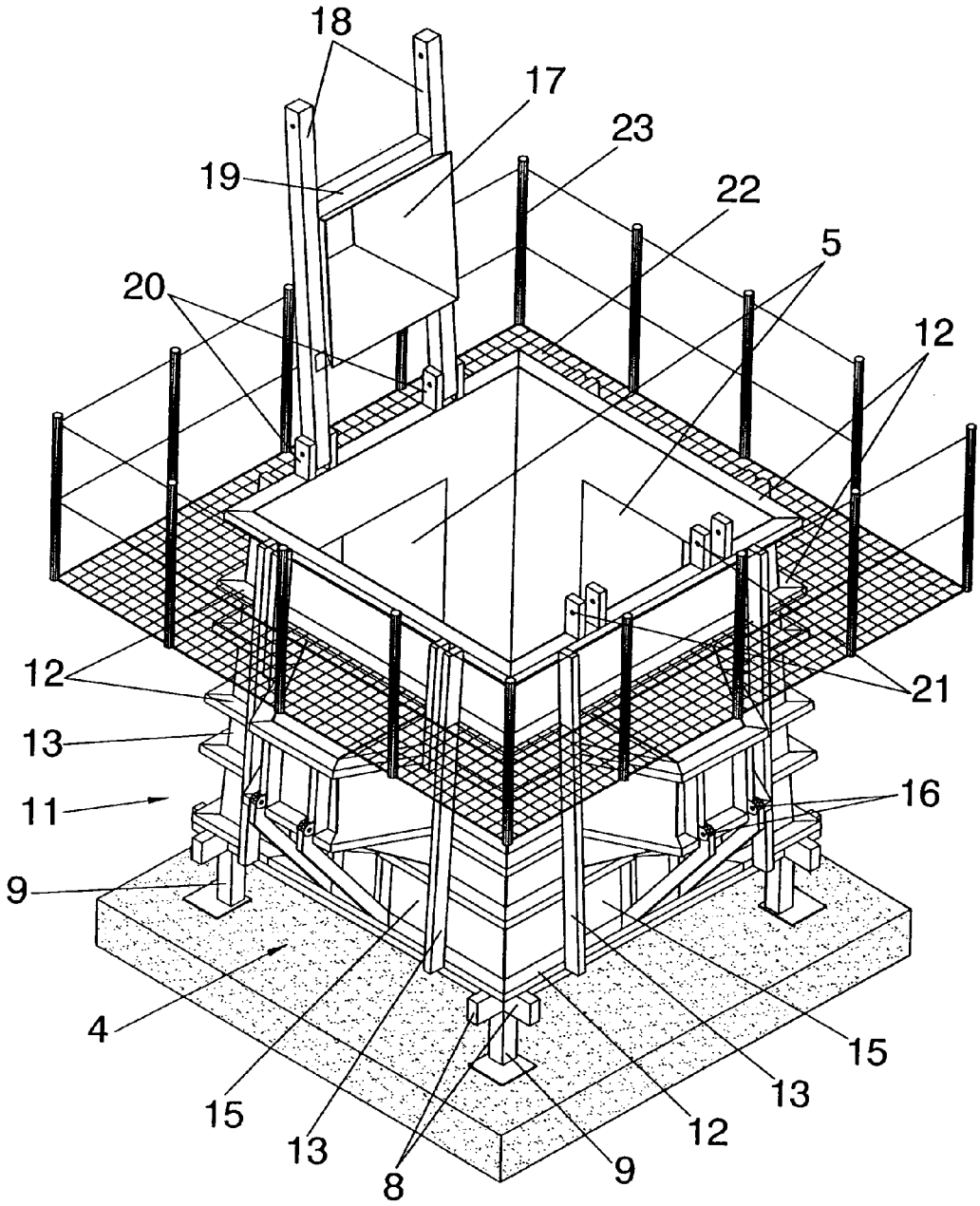
FIG. 3.—Is a perspective view of the mould complete and prepared for pouring the concrete.

In FIG. 3 can be seen that over the table 4 the casing constituting the rest of the formwork or mould has been coupled, referenced to with 11 and materializing the side surface of the cubic shape of the body 1 including the corresponding recesses 5 in order to form the truncated pyramid-shaped projections 2.

The casing 11 is rigidized with horizontal 12 and vertical 13 profiles, being anchored to the table 4 with pins. The recesses 5 are formed also with rigidizing sheets and profiles but they have the particularity that their bottom face 14, trapezoidal (see FIG. 7), together with the rectangular bottom portion 15 (FIG. 7) of the corresponding face of the casing 11 form a dihedral surface materialized by a plate upperly hinged at the axis 16. In FIG. 3 these dihedron close the recess 5 and side walls of the mould, being anchored with pins. When removing the mould these pins are released and the dihedral plates are separated as it is captured in FIG. 7. Thus there is no hindrance for raising the mould since the truncated pyramid-shaped projections 2 do not hinder this raising movement, as we will see more clearly in relation with the FIG. 8. The concrete block constructed will be located over the table 4.

Figure 4:
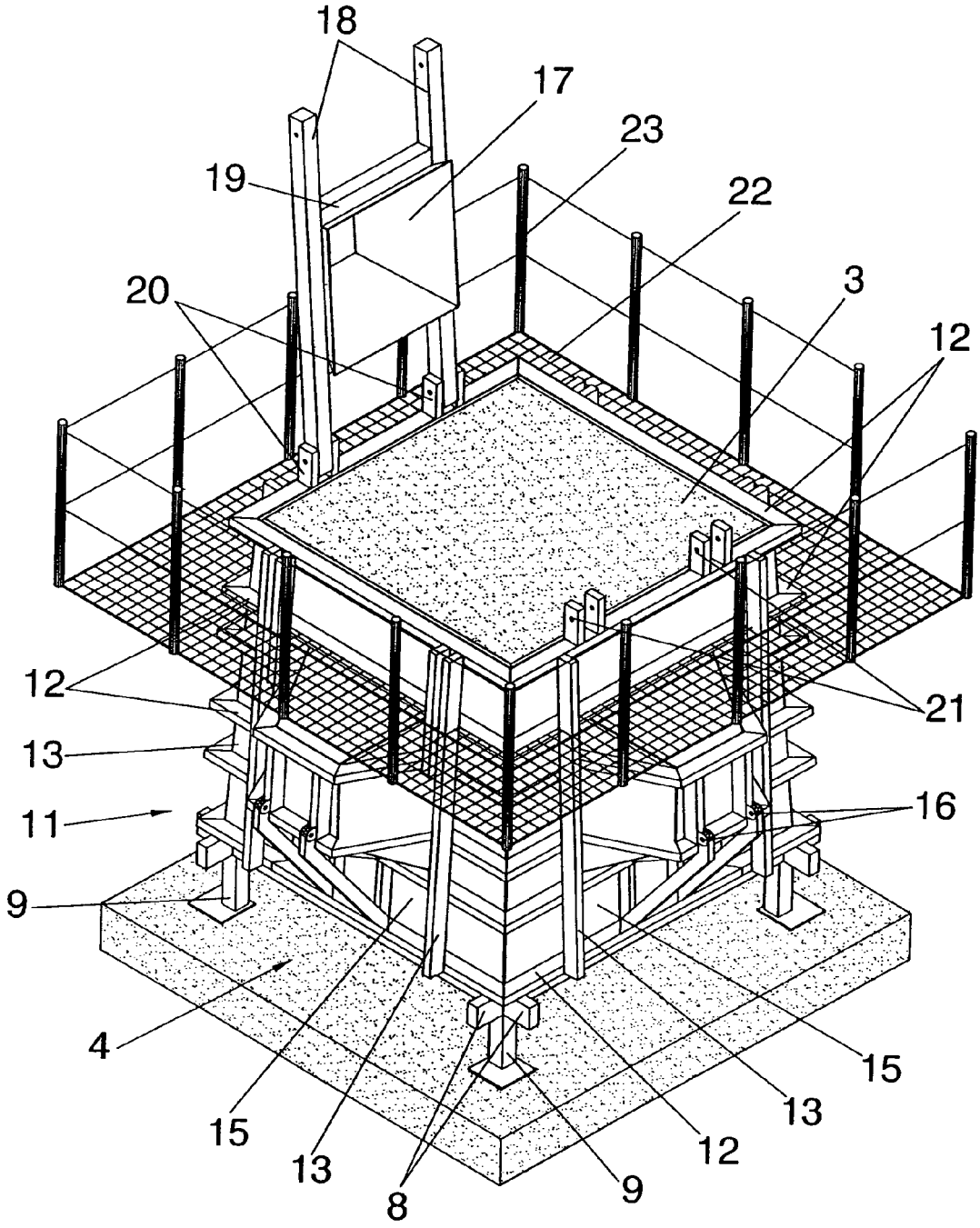
FIG. 4.—Is a view identical to FIG. 3, with the mould filled with concrete.
Figure 5:
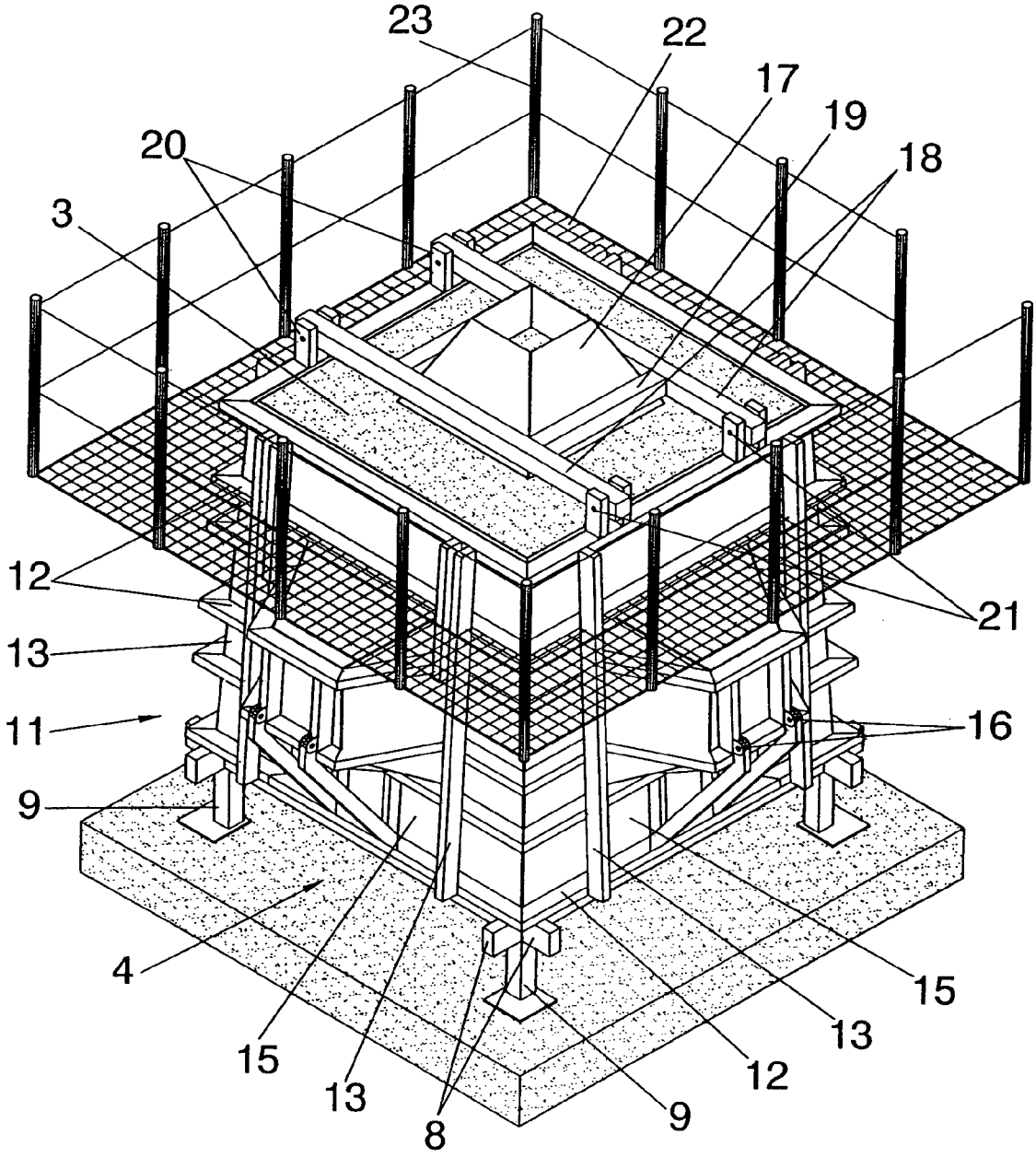
FIG. 5.—Is a view similar to FIG. 4, with the truncated pyramid-shaped hood down in order to form the upper projection of the cube.
Figure 6:
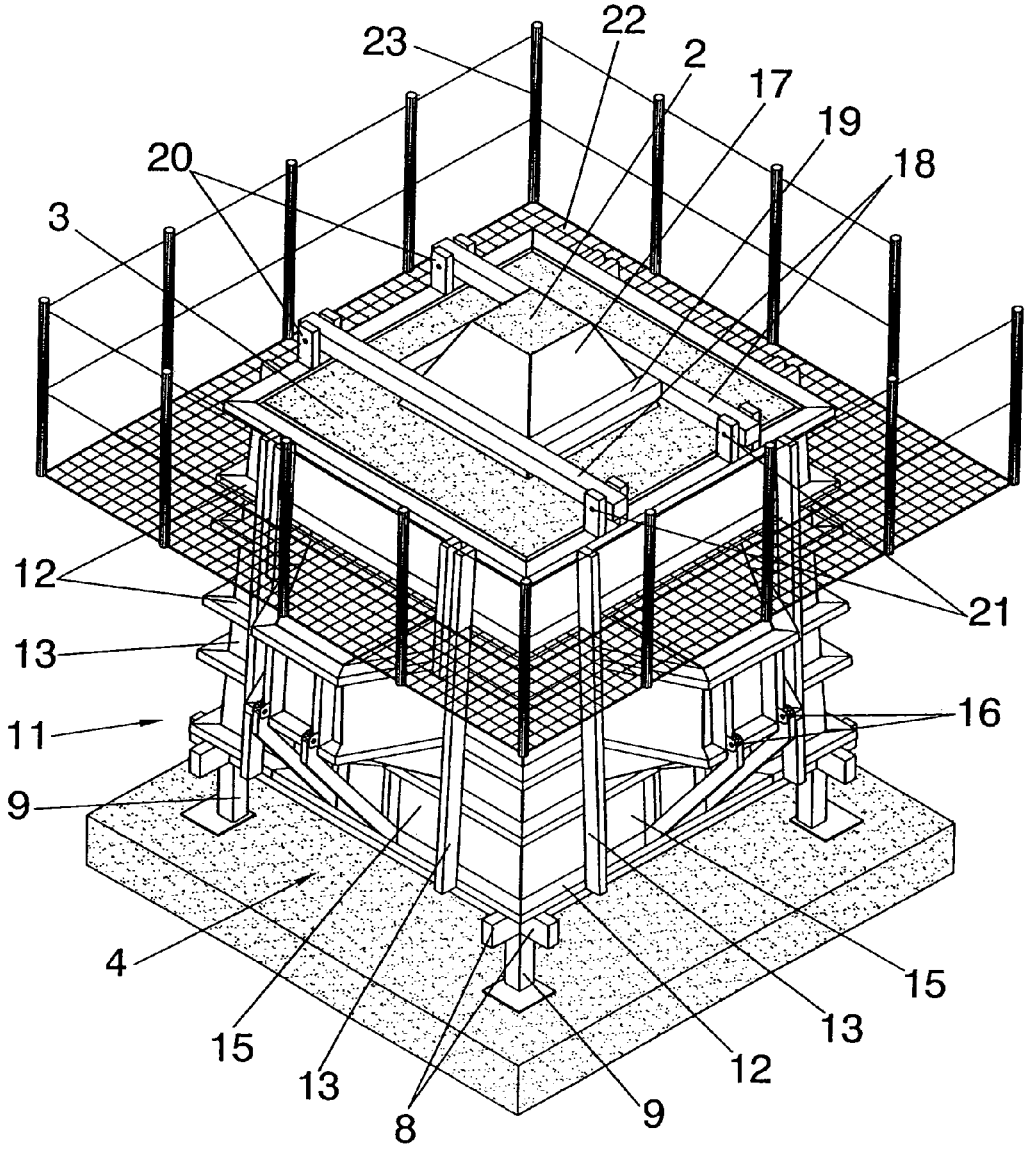
FIG. 6.—Is a view identical to FIG. 5, once the hood has been filled with the concrete.

Back to FIG. 3, the truncated pyramid-shaped hood 17 can be seen in the raised position integrally joined to the rigidizing frame of profiles 18 and 19, hinged at the snout of the casing 11 at semiaxis 20. In this position the mould is filled up to the rim as shown in FIG. 4. Then this frame is taken away and the hood 17 remains coupled and ready for being able to form the last upper projection, such as shown in FIG. 5, being anchored with pins 21. Next, the concrete is poured until filling the hood 17, vibrating it such that it perfectly joins together to the rest of the block.

Figure 7:
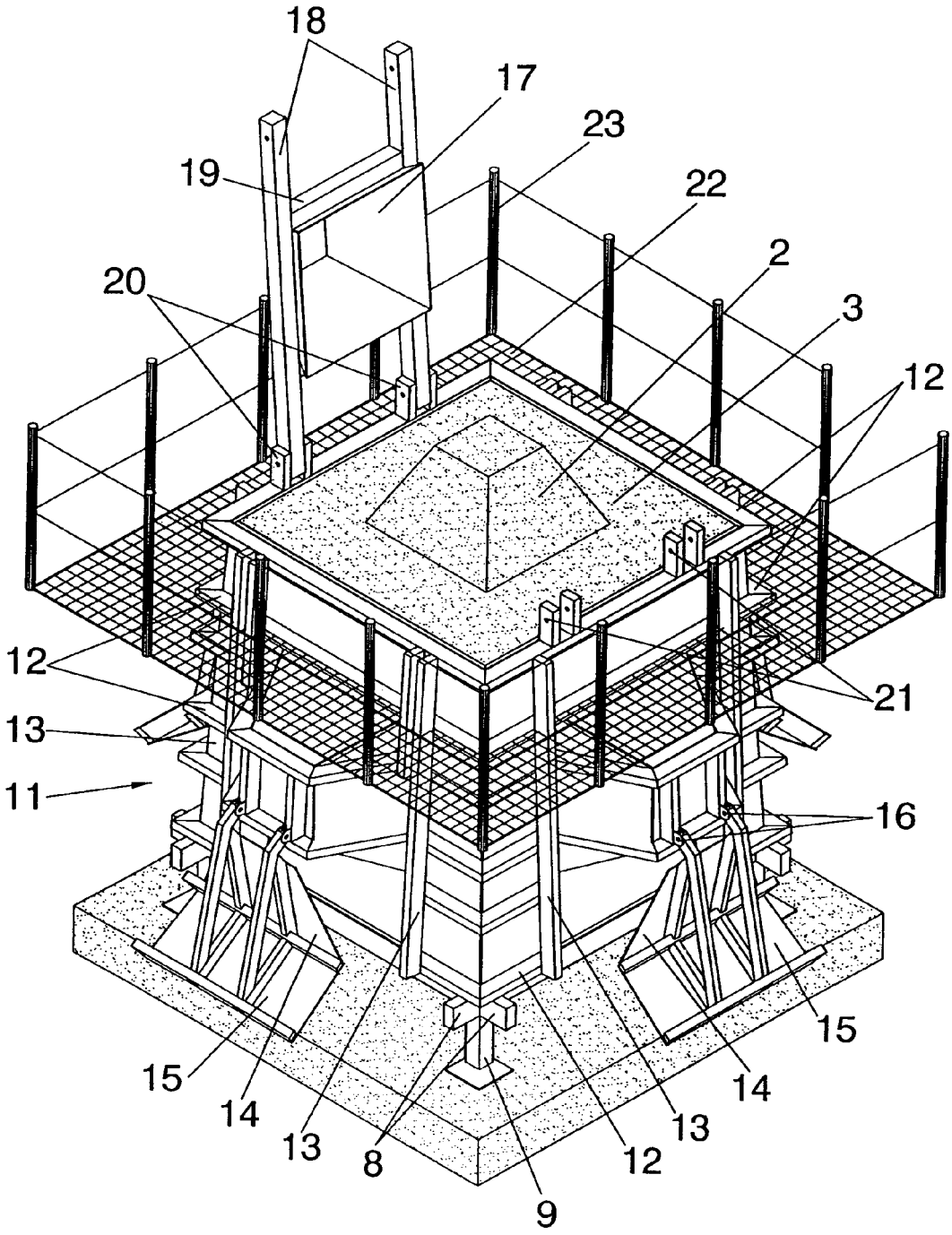
FIG. 7.—Is a perspective view showing a stage previous to the removal of the mould.
Figure 8:
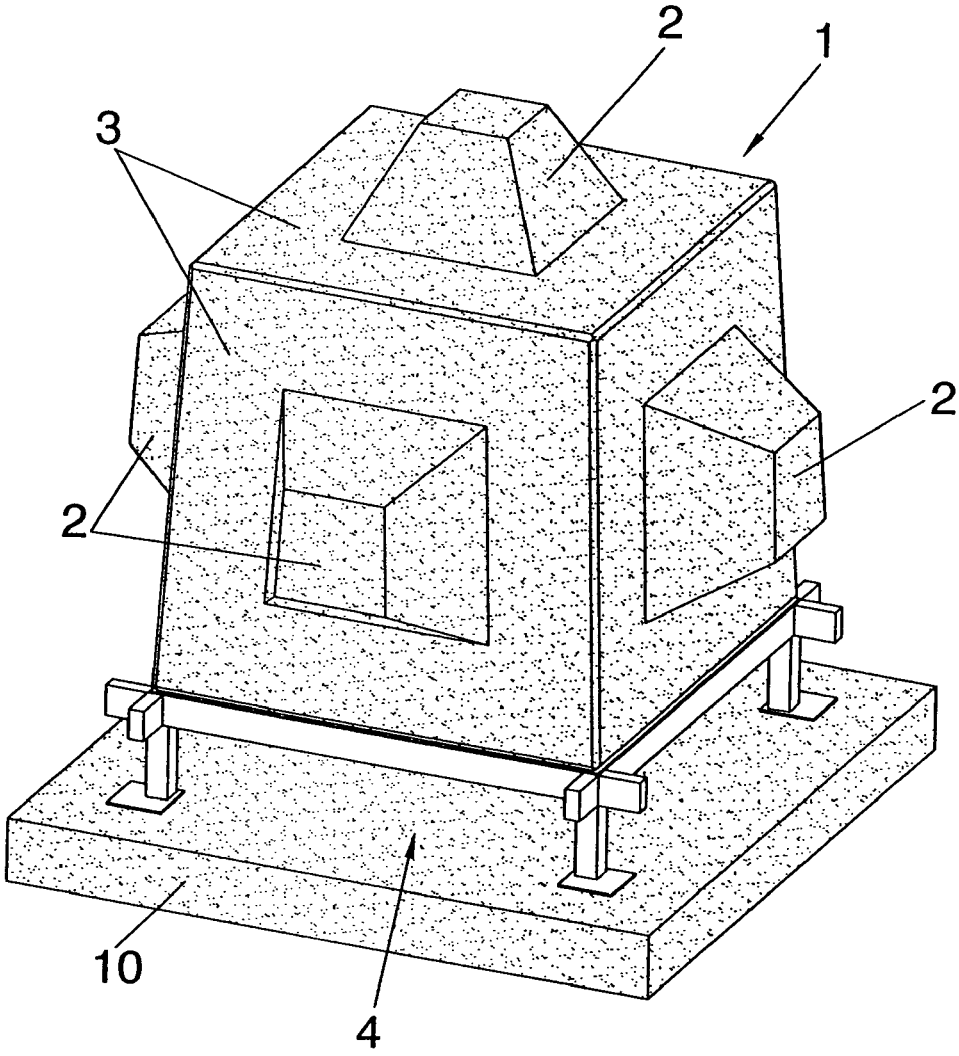
FIG. 8.—Is a perspective view showing a stage subsequent to FIG. 7, once the moving formwork or casing of the mould has been removed, after the time for the setting of the concrete has passed.

In FIG. 7 the removal of the mould is started by first raising the hood 17 and then raising the casing or mould, once the dihedral plates 14-15 have been released as we previously mentioned.

The casing 11 has externally and integrally joined a working platform 22 with safety handrail 23.

The invention claimed is:

1. A MOLD FOR MANUFACTURING A CONCRETE CUBIPOD, which is a heavy piece for protection of dyke mantles or breakwaters in coasts and the like, and defined by a cubic or orthohedral shape with at least two truncated pyramid shaped projections, wherein each said projection is located at the center of its faces, wherein said mold comprising a table (4) defined by a plate (6) corresponding to a base of the concrete cubipod, said table supported on a framework or frame of profiles (8) which lean on legs (9) anchored to a rigid plinth (10), said plate (6) having a window (7) in correspondence with a base of an inverted truncated pyramid-shaped projection closed by the base of the cubipod and integrally joined to said plate (6); and a casing (11) which fits on the table (4) and is fixed thereto by pins, complementing a geometrical form of cubipod, including one or more corresponding recesses (5) on side faces of said casing (11) configured to form one or more truncated pyramid shaped projections (2) on the side faces (3) of the concrete cubipod, said casing (11) being rigidized with reinforcement profiles (12, 13) having envisaged that the bottom face of the truncated pyramid-shaped projections (2) of the prismatic side surface of the cubipod, and a rectangular portion (15) of said casing (11) corresponding with its bottom edge (14), determine dihedral surface (14-15) hinged to the base of the truncated pyramid-shaped projections (2), which when rotated or raised allows the removal of the mold of the poured concrete, upon it setting, by raising said casing (11), being fixed in closed position by the pins.

2. A MOLD FOR MANUFACTURING A CONCRETE CUBIPOD, according to claim 1, wherein the casing (11) or prismatic side surface of the cubipod (1) is slightly truncated pyramid-shaped in order to facilitate removal of the mold.

3. A MOLD FOR MANUFACTURING A CONCRETE CUBIPOD, according to claim 1, wherein the upper face (3) of the cubipod, or filling mouth of the mold, has hinged a frame of profiles (18, 19) fixed in position with pins, to which a truncated pyramid-shaped hood (17) corresponding to the prismatic projection (2) which should be formed in the upper face (3) of the cubipod is integrally joined, lacking the base in order to subsequently form said upper projection (2) by pouring additional concrete once the mold has been filled up to the rim of the casing (11).

4. A MOLD FOR MANUFACTURING A CONCRETE CUBIPOD, according to claim 1, wherein the casing (11) has on its outer periphery a platform (22) and working handrails (23) for operators.

* * * * *

UNITED STATES PATENT AND TRADEMARK OFFICE

CERTIFICATE OF CORRECTION

PATENT NO. : 8,146,882 B2
APPLICATION NO. : 12/676928
DATED : April 3, 2012
INVENTOR(S) : Antonio Corredor Molguero et al.

It is certified that error appears in the above-identified patent and that said Letters Patent is hereby corrected as shown below:

Title page, item (73),

"Sociedad Anonima Trabajos y Obras Gobelas, Madrid (ES)"

should read

--Sociedad Anonima Trabajos y Obras, Gobelas, Madrid (ES)"--.

Signed and Sealed this
Twenty-sixth Day of February, 2013

Teresa Stanek Rea
*Acting Director of the United States Patent and Trademark Office*